US009707451B1

(12) United States Patent
Madson et al.

(10) Patent No.: US 9,707,451 B1
(45) Date of Patent: Jul. 18, 2017

(54) GOLF BALL HAVING DIMPLES WITH CONCENTRIC GROOVES

(71) Applicant: Acushnet Company, Fairhaven, MA (US)

(72) Inventors: Michael R. Madson, Easton, MA (US); Nicholas M. Nardacci, Barrington, RI (US); Chris Hixenbaugh, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/985,792

(22) Filed: Dec. 31, 2015

(51) Int. Cl.
*A63B 37/00* (2006.01)
*A63B 37/14* (2006.01)

(52) U.S. Cl.
CPC ..... *A63B 37/0006* (2013.01); *A63B 37/001* (2013.01); *A63B 37/002* (2013.01); *A63B 37/0011* (2013.01); *A63B 37/0004* (2013.01)

(58) Field of Classification Search
CPC ..... A63B 37/0011; A63B 37/0004; A63B 37/001
See application file for complete search history.

(56) References Cited

U.S. PATENT DOCUMENTS 6,475,106 B1 11/2002 Green et al. ..... 473/383
7,041,013 B2 5/2006 Ohama et al. ..... 473/384
7,273,426 B2 * 9/2007 Sato ..... A63B 37/0004 473/383
7,326,131 B2 * 2/2008 Sajima ..... A63B 37/0004 473/383
7,354,359 B2 4/2008 Sajima ..... 473/383
7,503,857 B2 * 3/2009 Kasashima ..... A63B 37/0004 473/383
7,618,332 B2 11/2009 Sato et al. ..... 473/383
8,591,355 B2 * 11/2013 Sullivan ..... A63B 37/0004 473/383
2011/0136590 A1 * 6/2011 Kim ..... A63B 37/0004 473/384
2012/0165130 A1 * 6/2012 Madson ..... A63B 37/0015 473/384
2013/0172123 A1 7/2013 Nardacci et al. ..... 473/383
2015/0119171 A1 4/2015 Madson et al.
2016/0184644 A1 * 6/2016 Sato ..... A63B 37/0007 473/383

* cited by examiner

*Primary Examiner* — John E Simms, Jr.

(74) *Attorney, Agent, or Firm* — Smith, Gambrell & Russell, LLP

(57) ABSTRACT

The present invention is directed to golf balls having improved aerodynamic performance due, at least in part, to the alteration of the dimple surfaces. In particular, the present invention relates to a golf ball that includes at least a portion of its dimples having circular perimeters and dimple profiles having a concentric groove on the surface of the dimple. The golf ball dimples of the present invention provide golf ball surfaces having unique appearances, while maintaining ideal aerodynamic characteristics.

19 Claims, 9 Drawing Sheets

GOLF BALL HAVING DIMPLES WITH CONCENTRIC GROOVES

FIELD OF THE INVENTION

The present invention relates to golf ball dimples having concentric grooves on the dimple surface. In particular, the present invention relates to golf ball dimples having circular perimeters and dimple profiles having a concentric groove on the surface of the dimple. When utilized on golf balls, the golf ball dimples of the present invention provide surfaces having unique appearances, while maintaining ideal aerodynamic characteristics.

BACKGROUND OF THE INVENTION

Golf balls generally include a spherical outer surface with a plurality of dimples formed thereon. The dimples on a golf ball improve the aerodynamic characteristics of a golf ball and, therefore, golf ball manufacturers have researched dimple patterns, shape, volume, and cross-section in order to improve the aerodynamic performance of a golf ball. Determining specific dimple arrangements and dimple shapes that result in an aerodynamic advantage requires an understanding of how a golf ball travels through air.

As a threshold matter, a ball without dimples encounters no turbulence in the thin layer of air that flows close to the surface of a golf ball (i.e., the boundary layer). When a ball includes a number of dimples on the surface, the boundary layer becomes turbulent, which moves the separation point, i.e., the point in which the air separates from the surface of the ball, further backward, so that the layer stays attached further along the outer surface of the ball. It is the circumference portion of each dimple, where the dimple wall drops away from the outer surface of the ball, which actually creates the turbulence in the boundary layer.

Aerodynamic forces acting on a golf ball are typically resolved into orthogonal components of lift ($F_L$) and drag ($F_D$). Lift is defined as the aerodynamic force component acting perpendicular to the flight path. It results from a difference in pressure that is created by a distortion in the air flow that results from the back spin of the ball. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Drag is defined as the aerodynamic force component acting parallel to the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. The air separates from the surface of the ball, leaving a large turbulent flow area with low pressure, i.e., the wake. The difference between the high pressure in front of the ball and the low pressure behind the ball reduces the ball speed and acts as the primary source of drag.

Lift and drag, among other aerodynamic characteristics of a golf ball, are influenced by the external surface geometry of the ball, which includes the dimples thereon. As such, the dimples on a golf ball play an important role in controlling those parameters. For example, the dimples on a golf ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

The design variables associated with the external surface geometry of a golf ball, e.g., surface coverage, dimple pattern layout, and individual dimple geometries, provide golf ball manufacturers the ability to control and optimize ball flight. Recently, golf ball manufacturers have begun to alter the surfaces of the dimple profiles in an attempt to optimize aerodynamic characteristics. However, adjustments and alterations to dimple profiles do not always result in enhanced aerodynamic performance.

Accordingly, there remains a need for a dimple profile having an altered surface that provides unique surface appearances, while maintaining desirable aerodynamic characteristics and ideal flight conditions.

SUMMARY OF THE INVENTION

The present invention is directed to a golf ball having a substantially spherical surface, including a plurality of circular dimples on the spherical surface, wherein at least a portion of the plurality of circular dimples include a concentric groove on each dimple surface, wherein each concentric groove has a groove diameter and each dimple has a dimple diameter, wherein a ratio of groove diameter to dimple diameter is about 0.05 to about 0.95, and wherein a ratio of $$\frac{S \cdot N}{4\pi R^2 P}$$

is about 0.01 or less, wherein S is the average surface area for all grooves on the ball, N is the number of grooved dimples on the ball, R is the radius of the ball, and P is the surface coverage of a dimple pattern used on the ball. In one embodiment, the groove diameter is about 0.0025 inches to about 0.285 inches. In another embodiment, the dimple diameter is about 0.050 inches to about 0.300 inches. In still another embodiment, each concentric groove has a width of about 0.00250 inches to about 0.0150 inches. In yet another embodiment, each concentric groove has a depth of about 0.0010 inches to about 0.0050 inches. Indeed, the concentric groove may have a half circular, triangular, or half square profile.

The present invention is also directed to a golf ball having a substantially spherical surface, including a plurality of dimples on the spherical surface, wherein at least 50 percent of the plurality of dimples include a circular perimeter, a dimple profile defined by a continuous function, and at least one concentric groove on a surface of the dimple profile, wherein the golf ball has a ratio of surface area of the grooves on the golf ball to the total surface area of the golf ball that is replaced by the plurality of dimples of about 0.010 or less, for example, of about 0.008 or less.

In one embodiment, the dimple profile is selected from the group consisting of spherical, conical, catenary, elliptical, polynomial, Witch of Agnesi, frequency, Neiles parabola, sine, cosine, hyperbolic sine, and hyperbolic cosine. For example, the dimple profile may be spherical, conical, or catenary. In another embodiment, the concentric groove has a profile that is substantially identical to the dimple profile. In still another embodiment, the concentric groove has a profile defined by the superposition of two or more continuous functions. In yet another embodiment, the concentric groove has a half circular, triangular, or half square profile. In this aspect, the portion of the plurality of circular dimples has a ratio of groove diameter to dimple diameter of about 0.20 to about 0.80.

The present invention is further directed to a golf ball dimple having a circular plan shape, including a circular plan shape; a spherical, conical, or catenary dimple profile; and at least one concentric groove on a surface of the dimple profile, wherein the concentric groove has a diameter of about 0.0025 inches to about 0.285 inches, a depth of about 0.0015 inches to about 0.0050 inches, and a width of about 0.0025 inches to about 0.0150 inches. In one embodiment, the concentric groove has a profile selected from the group consisting of half circular, half triangular, half square, half pentagonal, half hexagonal, half heptagonal, or half octagonal. For example, the profile of the concentric groove may be half circular, triangular, or half square. In another embodiment, the golf ball dimple further includes two concentric grooves on the surface of the dimple profile. In still another embodiment, the golf ball dimple further includes a ratio of groove diameter to dimple diameter of about 0.30 to about 0.70.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

The present invention is directed to golf ball dimples having concentric grooves on the dimple surface. In particular, the present invention is directed to a golf ball dimple having a circular plan shape, a profile defined by a continuous function, and a concentric groove on the surface of the dimple. The present invention is also directed to the use of one or more of the dimples of the present invention in a dimple pattern applied to a golf ball.

Advantageously, in one embodiment, golf balls including dimples produced in accordance with the present invention have visually distinct surface textures. Indeed, the dimples of the present invention possess a unique visual appearance. Additionally, in another embodiment, the dimples of the present invention result in enhanced aerodynamic performance. In particular, the concentric groove lowers the air resistance immediately after the ball is hit because the boundary layer is thin, but has little to no effect on the thicker boundary layer once the ball is at the highest point of its trajectory and, thus, ultimately maintains lift. As a result, golf balls including the dimples of the present invention have visually distinct appearances that maintain ideal flight conditions.

Figure 1:
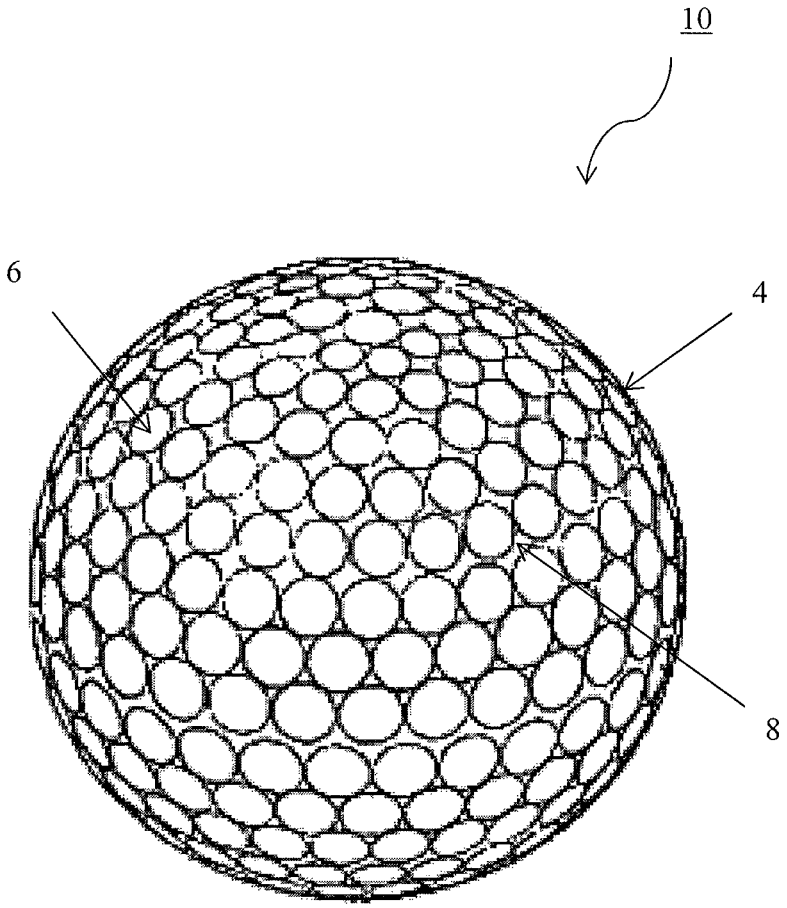
FIG. 1 illustrates a golf ball according to one embodiment of the present invention.

Referring to FIG. 1, a golf ball 10 has a spherical core (not shown) and a cover 4. Numerous dimples 6 are formed on the cover 4 of the golf ball. The upper flattened portion of the cover 4 extending from dimple to dimple is the land surface 8. Each dimple 6 has a plan shape. A dimple plan shape, as used herein, refers to the perimeter of the dimple as seen from a top view of the dimple, or the demarcation between the dimple and the outer surface of the golf ball or fret surface. The present invention contemplates dimples having a circular plan shape.

According to the present invention, each circular dimple has a dimple profile. A dimple profile, as used herein, refers to the cross section of the dimple as seen from a side view of the dimple. The present invention contemplates dimples having profiles created from a continuous function. For example, the dimples of the present invention have circular plan shapes and corresponding dimple profiles that begin as a continuous function.

The profile of dimples according to the present invention may be defined by any known continuous function. For example, a continuous function is a function for which small changes in the input result in small changes in the output. In one embodiment, the present invention contemplates the use of continuous functions that lead to smooth transitions of the dimple profile to the golf ball surface.

In this aspect, the dimple profiles of the present invention may be defined by any continuous function including, but not limited to, a polynomial function, an exponential function, a trigonometric function, and a hyperbolic function. Specific non-limiting examples of suitable dimple profiles contemplated by the present invention include those that can be defined by the following functions: spherical, conical, catenary, elliptical, polynomial, Witch of Agnesi, frequency, Neiles parabola, sine, cosine, hyperbolic sine, and hyperbolic cosine profiles.

Figure 2A:
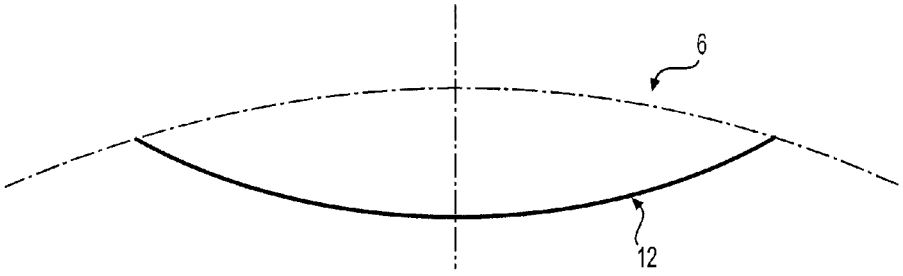
FIGS. 2A-2C illustrate various dimple profile shapes contemplated by the present invention.
Figure 2B:
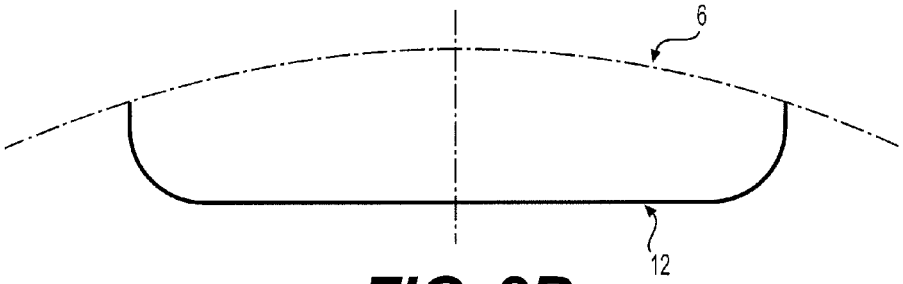
Figure 2C:
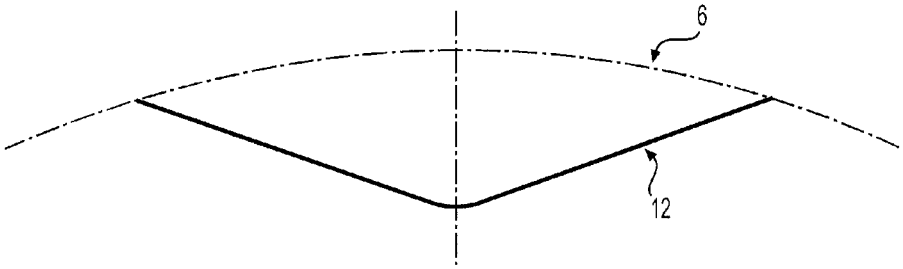

FIGS. 2A-2C illustrate various dimple profile shapes contemplated by the present invention. As shown in FIGS. 2A-2C, the dotted line represents the phantom spherical face of the dimple (i.e., the region of the surface of the golf ball that was cut away to form the dimple). In one embodiment, the dimple profile of the present invention is defined by a spherical profile. For example, FIG. 2A shows a cross-sectional view of a dimple 6 having a spherical profile 12. In another embodiment, the dimple profile of the present invention is defined by a catenary curve. As shown in FIG. 2B, a dimple 6 according to the present invention may have a catenary profile 12. In yet another embodiment, the dimple profile of the present invention is defined by a conical profile. Indeed, FIG. 2C shows a cross-sectional view of a dimple 6 having a conical profile 12.

According to one embodiment of the present invention, the circular golf ball dimples of the present invention include at least one groove on the dimple surface. In this aspect, the dimple includes a groove along the dimple profile surface such that no part of the groove is in contact with the land surface of the golf ball. In one embodiment, the groove is concentric with the dimple perimeter so that the groove maintains a circular plan shape.

Figure 3A:
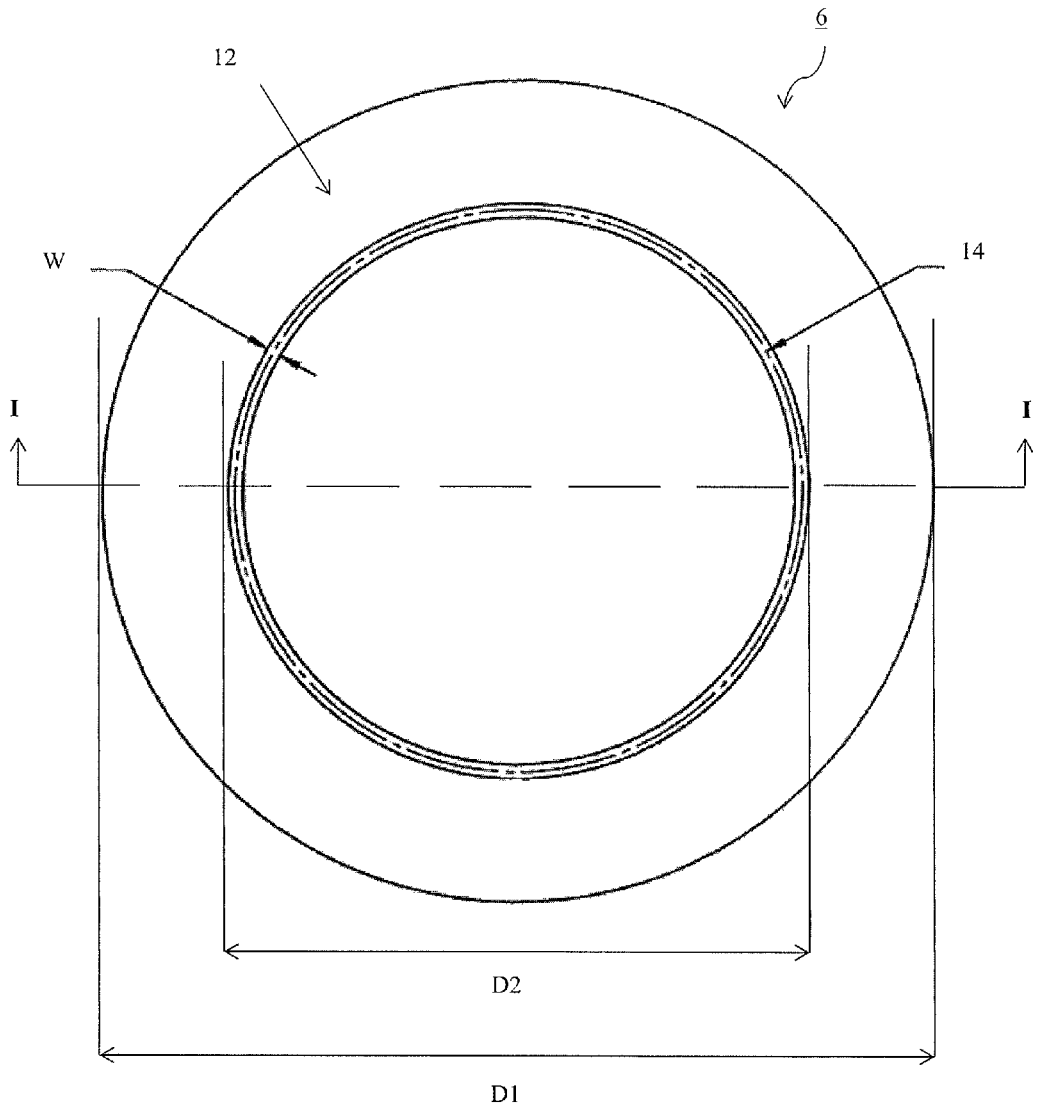
FIG. 3A illustrates an enlarged top plan view of a dimple according to an embodiment of the present invention.
Figure 3B:
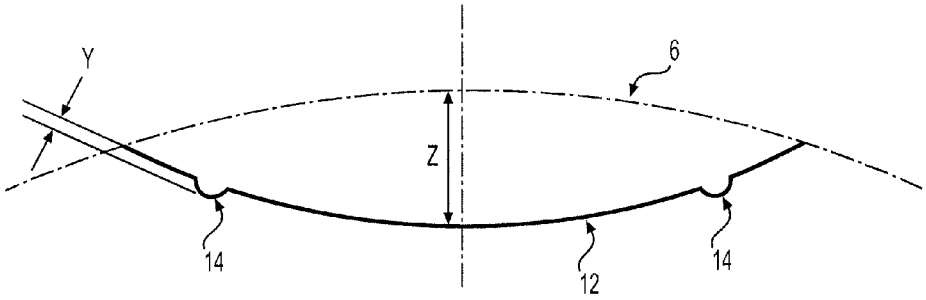
FIGS. 3B and 3C illustrate cross-sectional views (I-I) of the dimple depicted in FIG. 3A.

FIG. 3A illustrates an enlarged top plan view of a dimple according to one embodiment the present invention. As shown in FIG. 3A, the dimple 6 includes a dimple profile 12 and a concentric groove 14 on the surface of the dimple profile 12. The double dashed line located within the groove 14 represents the region of the surface that was cut away to form the groove 14. FIG. 3B is a cross-sectional view (I-I) of the dimple depicted in FIG. 3A. As shown in FIG. 3B, the dimple profile 12 begins as a continuous sloping profile and includes a groove 14 that forms a recess in the sloping profile. The dotted line shown in FIG. 3B represents the phantom spherical face of the dimple (i.e., the region of the surface of the golf ball that was cut away to form the dimple).

As shown in FIG. 3A, the dimple 6 has a diameter. For example, the dimple diameter D1 represents the distance between contact points when common tangent lines are depicted at both sides of the dimple 6. In one embodiment, the dimple diameter D1 is about 0.050 inches to about 0.300 inches. In another embodiment, the dimple diameter D1 is about 0.075 inches to about 0.275 inches. In yet another embodiment, the dimple diameter D1 is about 0.100 inches to about 0.250 inches. In still another embodiment, the dimple diameter D1 is about 0.125 inches to about 0.225 inches.

The dimple 6 also has a depth. As shown in FIG. 3B, the dimple depth is depicted by the double sided arrow Z. Indeed, the dimple depth Z represents the distance between the deepest part of the dimple 6 and the phantom spherical face of the dimple. In one embodiment, the dimple depth Z is within a range of about 0.003 inches to about 0.025 inches. In another embodiment, the dimple depth Z is about 0.005 inches to about 0.020 inches. In still another embodiment, the dimple depth Z is about 0.006 inches to about 0.017 inches.

Figure 3C:
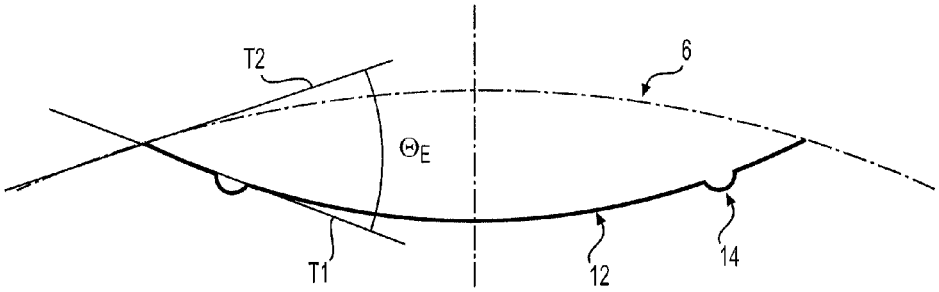

When the dimple profile is spherical, the dimple 6 also has an edge angle. Edge angle is often used in place of depth when describing spherical dimple profiles. The edge angle ($\Theta_E$) is defined as the angle between a first tangent line at the conical edge of the dimple profile and a second tangent line at the phantom ball surface. For example, as shown in FIG. 3C, the edge angle $\Theta_E$ is defined as the angle between the first tangent line T1 and the second tangent line T2. In one embodiment, the edge angle is about 10 degrees to about 15 degrees. In another embodiment, the edge angle may be about 13 degrees to about 15 degrees. For example, the edge angle may be about 14 degrees.

The concentric groove 14 has a diameter. As shown in FIG. 3A, the groove diameter D2 represents the distance between contact points when common tangent lines are depicted at both sides of the concentric groove 14. In one embodiment, the groove diameter D2 is about 0.0025 inches to about 0.285 inches. In another embodiment, the groove diameter D2 is about 0.0075 inches to about 0.250 inches. In yet another embodiment, the groove diameter D2 is about 0.010 inches to about 0.200 inches. In still another embodiment, the groove diameter D2 is about 0.050 inches to about 0.175 inches. Indeed, the groove diameter D2 may be about 0.100 inches to about 0.150 inches.

The location of the groove 14 on the dimple surface 12 may vary. In this aspect, the ratio of the groove diameter D2 to the dimple diameter D1 determines the location of the groove 14 along the dimple profile 12. For example, as will be apparent to one of ordinary skill in the art, a ratio approaching 1.00 will result in a groove located closer to the outer edge of the dimple, while a ratio approaching zero will result in a groove located closer to the center of the dimple.

The concentric groove diameter D2 maintains a given ratio to the corresponding dimple diameter D1. In one embodiment, the ratio of the groove diameter D2 to the dimple diameter D1 is about 0.05 to about 0.95. In another embodiment, the ratio of the groove diameter D2 to the dimple diameter D1 is about 0.10 to about 0.90. In still another embodiment, the ratio of the groove diameter D2 to the dimple diameter D1 is about 0.20 to about 0.80. In yet another embodiment, the ratio of the groove diameter D2 to the dimple diameter D1 is about 0.30 to about 0.70. In still another embodiment, the ratio of the groove diameter D2 to the dimple diameter D1 is about 0.40 to about 0.60.

The groove 14 also has a width. As shown in FIG. 3A, the width W of the groove 14 represents the distance between the outer and the inner edges of the groove 14. In one embodiment, the width W of the groove 14 is about 0.0150 inches or less. In another embodiment, the width W of the groove 14 is about 0.0100 inches or less. In still another embodiment, the width W of the groove 14 is about 0.0075 inches or less. In still another embodiment, the width W of the groove 14 is about 0.0050 inches or less. In yet another embodiment, the width W of the groove 14 is about 0.0025 inches or less.

The width W of the groove 14 may also be expressed as a ratio with the dimple diameter D1. In one embodiment, the width W of the groove is selected such that the ratio between the width W and the dimple diameter D1 is less than or equal to 0.05. In another embodiment, the ratio of the width W to the dimple diameter D1 is less than or equal to 0.04. In still another embodiment, the ratio of the width W to the dimple diameter D1 is less than or equal to 0.03. In yet another embodiment, the ratio of the width W to the dimple diameter D1 is less than or equal to 0.02.

In addition, the width W of the groove 14 may also be expressed as a ratio with the groove diameter D2. In one embodiment, the width W of the groove is selected such that the ratio between the width W and the groove diameter D2 ranges from about 0.018 to about 0.100. In another embodiment, the ratio of the width W to the groove diameter D2 ranges from about 0.018 to about 0.070. In still another embodiment, the ratio of the width W to the groove diameter D2 ranges from about 0.018 to about 0.053.

Further, the groove 14 has a depth. As shown in the cross-sectional view of FIG. 3B, the depth Y represents the distance from the phantom surface of the dimple profile 12 to the deepest portion of the groove 14. In one embodiment, the depth Y is about 0.0050 inches or less. In another embodiment, the depth Y is about 0.0025 inches or less. In still another embodiment, the depth Y is about 0.0015 inches or less. In yet another embodiment, the depth Y is about 0.0010 inches or less.

Figure 4A:
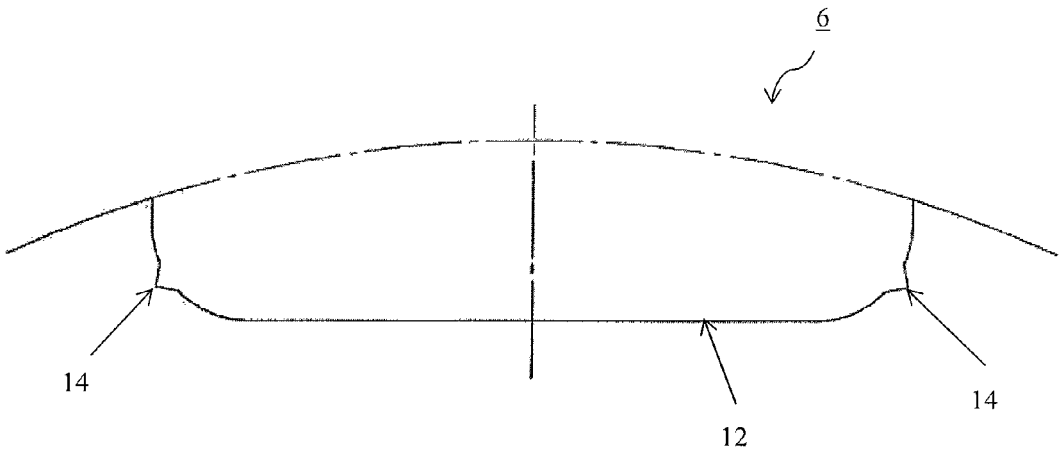
FIG. 4A-4B illustrate various groove profile shapes contemplated by the present invention.
Figure 4B:
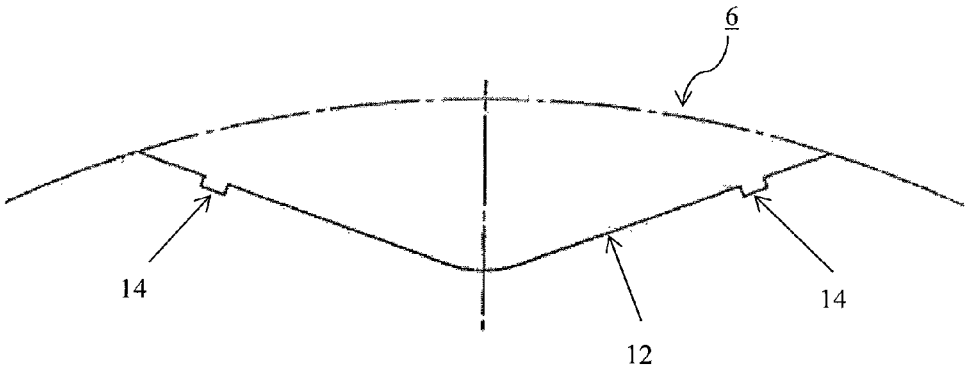

The cross-sectional shape of the groove 14 may also vary. As would be understood by one of ordinary skill in the art, the cross-sectional shape of the groove refers to the shape of the groove profile. In one embodiment, the cross-sectional shape of the groove 14 is half circular. For example, as shown in FIG. 3B, the cross-sectional shape of the groove 14 may be half round. In another embodiment, the cross-sectional shape of the groove 14 is half polygonal. Indeed, in this aspect of the invention, suitable polygons include, but are not limited to, triangles, squares, pentagons, hexagons, heptagons, and octagons. For instance, as shown in FIG. 4A, the cross-sectional shape of the groove 14 may be triangular such that the top phantom surface of the groove is the third leg of the triangle. Further, the cross-sectional shape of the groove 14 may be half of a square as shown in FIG. 4B. In yet another embodiment, the cross-sectional shape of the groove 14 may be half pentagonal, half hexagonal, half heptagonal, or half octagonal.

In another embodiment, the cross-sectional shape of the groove 14 is identical to the shape of the dimple profile 12. Indeed, any of the dimple profile shapes discussed above may be utilized as the profile of the groove. In still another embodiment, the cross-sectional shape of the groove 14 is defined by the superposition of two or more continuous and differentiable functions. For example, the cross-sectional shape of the groove 14 may be defined by combining a spherical curve and a different curve, such as a cosine curve, a frequency curve, or a catenary curve, as disclosed in U.S. Patent Publication Nos. 2015/0119171 and 2012/0165130, the entire disclosures of which are incorporated by reference herein.

In yet another embodiment, the profile of the groove 14 can be a weighted function. In this regard, the weighted function can be used to selectively control or modify the profile of the groove 14. For example, one or more continuous weighting functions can be applied as multiplicative constructs to the profile defined by any of the continuous functions discussed above to result in a continuous, differentiable weighted profile, as disclosed in U.S. Patent Publication No. 2013/0172123, which is incorporated in its entirety by reference herein.

Based on the width W, depth Y, and shape of the groove 14, the surface area of the groove 14 may vary. However, in one embodiment, the surface area of the groove 14 is about 0.00010 square inches to about 0.010 square inches. In another embodiment, the surface area of the groove 14 is about 0.00020 square inches to about 0.0050 square inches. In still another embodiment, the surface area of the groove 14 is about 0.00025 square inches to about 0.0010 square inches.

In this aspect of the invention, the surface area of the dimple 6 is increased by the addition of the concentric groove 14. In one embodiment, the surface area of the dimple 6 having the groove 14 is increased by about 1.0 percent when compared to the surface area of a dimple without a groove. In another embodiment, the surface area of the dimple 6 having the groove 14 is increased by about 2.0 percent when compared to the surface area of a dimple without a groove. In still another embodiment, the surface area of the dimple 6 having the groove 14 is increased by about 3.0 percent when compared to the surface area of a dimple without a groove.

In another embodiment, the relationship between the surface area of the grooves on the ball and the surface area of the parts of the ball that are replaced by dimples can be expressed as the following ratio:

$$\frac{S \cdot N}{4\pi R^2 P}$$

where:

S is the average surface area for all grooves on the ball;

N is the number of grooved dimples on the ball;

R is the radius of the ball; and

P is the surface coverage of the dimple pattern used on the ball.

In this aspect of the present invention, the number of dimples on the ball may range from about 200 dimples to about 500 dimples. In another embodiment, the number of dimples may range from about 250 dimples to about 450 dimples. In still another embodiment, the number of dimples may range from about 300 dimples to 400 dimples. In yet another embodiment, the number of dimples may range from 300 to 350 dimples.

While the grooved dimples of the present invention may be used for one or more dimples on a golf ball, it is not necessary that the grooved dimples be used on every dimple of a golf ball. In general, it is preferred that a sufficient number of dimples on the ball are constructed in accordance with the present invention so that the aerodynamic characteristics of the ball may be altered. In this aspect of the present invention, the number of grooved dimples on the ball N may range from at least about 15 percent of the dimples to about 100 percent of the dimples. For example, at least about 25 percent of the dimples on the golf ball include at least one concentric groove according to the present invention. In another embodiment, at least about 50 percent of the dimples on the golf ball include at least one concentric groove according to the present invention. In still another embodiment, at least about 70 percent of the dimples on the golf ball include at least one concentric groove according to the present invention. In yet another embodiment, at least about 90 percent of the dimples on the golf ball include at least one concentric groove. Indeed, 100 percent of the dimples on the golf ball may include the grooved dimples of the present invention.

In one embodiment, the total surface area for all grooves on the ball (represented by S·N) may range from about 0.010 square inches to about 0.080 square inches. In another embodiment, the total surface area for all grooves on the ball may range from about 0.020 square inches to about 0.070 square inches. In still another embodiment, the total surface area for all grooves on the ball may range from about 0.030 square inches to about 0.060 square inches. For example, the average surface area for all grooves on the ball may be about 0.050 square inches.

In this aspect, the diameter of the golf ball may range from about 1.680 inches to about 1.800 inches, more preferably from about 1.680 inches to about 1.760 inches. A diameter of from about 1.680 inches (43 mm) to about 1.740 inches (44 mm) is most preferred. Thus, in one embodiment, the radius of the ball R may range from about 0.840 inches to about 0.880 inches. In another embodiment, the radius of the ball R may range from about 0.840 inches to about 0.870 inches.

Further, in this aspect of the invention, the surface coverage of all dimples on the ball P may range from about 65 percent to about 90 percent. In another embodiment, the surface coverage of all dimples P may range from about 70 percent to 88 percent. In still another embodiment, the surface coverage of all dimples P may range from about 72 percent to 85 percent. In yet another embodiment, the surface coverage of all dimples P may range from about 75 percent to 83 percent.

The surface coverage of a dimple pattern P is related to the total surface area of the golf ball that is replaced by dimples. In this aspect, the total surface area of the ball that is replaced by a dimple pattern may range from about 5.70 square inches to about 8.00 square inches. In another embodiment, the total surface area of the ball that is replaced by a dimple pattern may range from about 6.20 square inches to about 7.80 square inches. In still another embodiment, the total surface area of the ball that is replaced by a dimple pattern may range from about 6.40 square inches to about 7.50 square inches. For example the total surface area of the ball that is replaced by a dimple pattern may be about 7.35 square inches.

Overall, according to the present invention, the ratio of the surface area of the grooves on the ball to the total surface area of the ball that is replaced by dimples (as described above) is about 0.010 or less. In another embodiment, the ratio of the surface area of the grooves on the ball to the total surface area of the ball that is replaced by dimples is about 0.008 or less. In still another embodiment, the ratio of the surface area of the grooves on the ball to the total surface area of the ball that is replaced by dimples is about 0.006 or less. In yet another embodiment, the ratio of the surface area of the grooves on the ball to the total surface area of the ball that is replaced by dimples is about 0.005 or less.

Figure 5:
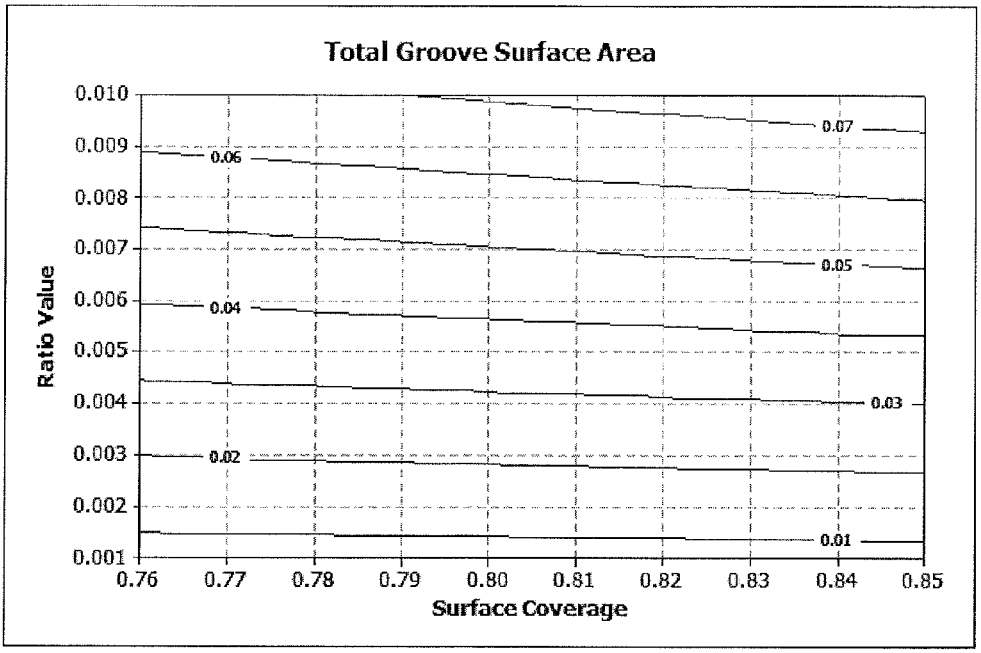
FIG. 5 is a graphical representation of groove surface areas.

FIG. 5 shows the relationship between the ratio of the surface area of the grooves on the ball to the surface area of a spherical ball that is replaced by dimples. For example, at a total groove surface area of 0.06 square inches, the ratio value (e.g., the ratio of the surface area of the grooves on the ball to the total surface area of the ball that is replaced by a dimple pattern) decreases from about 0.009 to about 0.008 as the surface coverage increases over a range of 0.76 to 0.85. Similarly, at a total groove surface area of 0.03 square inches, the ratio value (e.g., the ratio of the surface area of the grooves on the ball to the total surface area of the ball that is replaced by a dimple pattern) decreases from about 0.0045 to about 0.004 as the surface coverage increases over a range of 0.76 to 0.85.

While the dimples of the present invention have been described herein as having one groove, it should be understood that the dimples of the present invention may include one or more concentric grooves. In one embodiment, the dimples of the present invention include at least two concentric grooves 14. In another embodiment, the dimples of the present invention include at least three concentric grooves 14. In this aspect, the grooves 14 may be located at any point along the dimple profile surface so long as the dimensions of the grooves 14 are within the parameters discussed above.

Dimple Patterns & Packing

Figure 6:
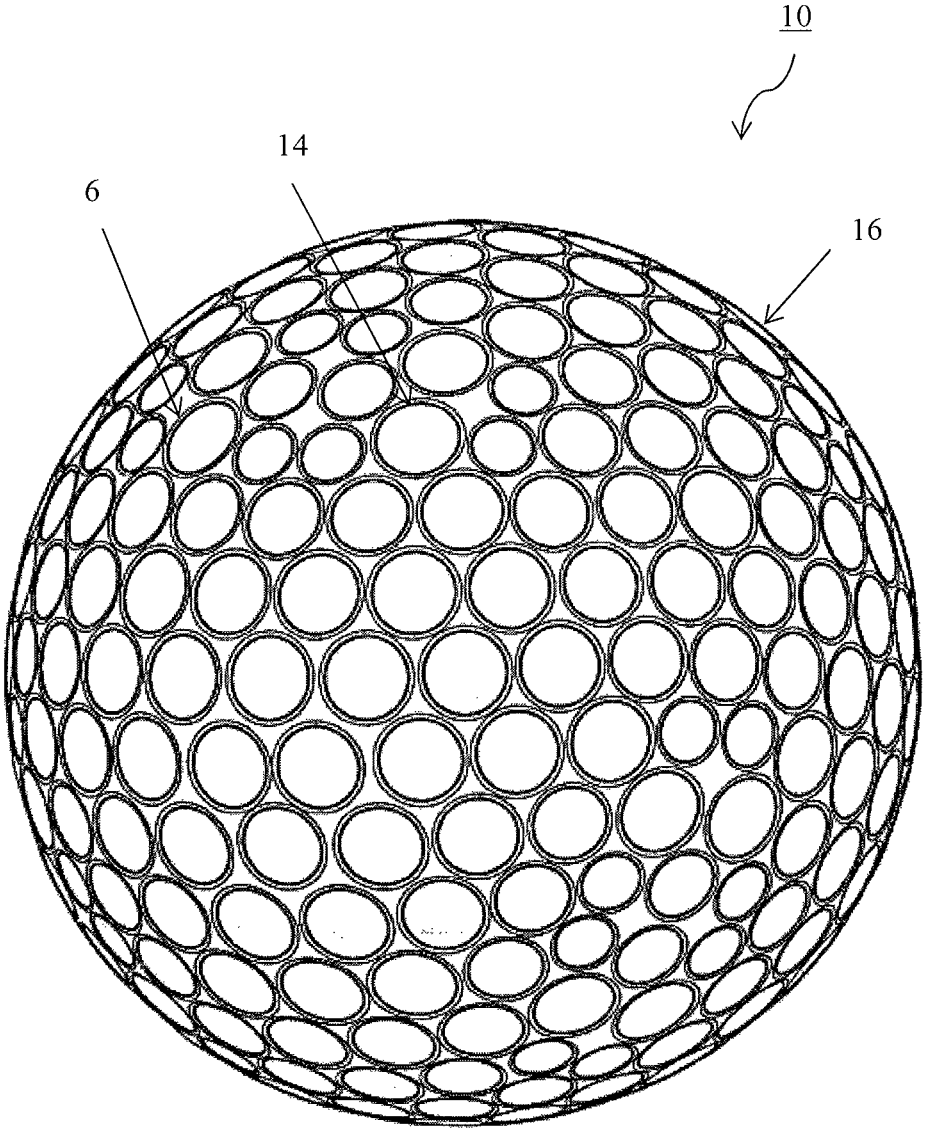
FIG. 6 illustrates a dimple pattern of a golf ball created in accordance with one embodiment of the present invention.
Figure 7:
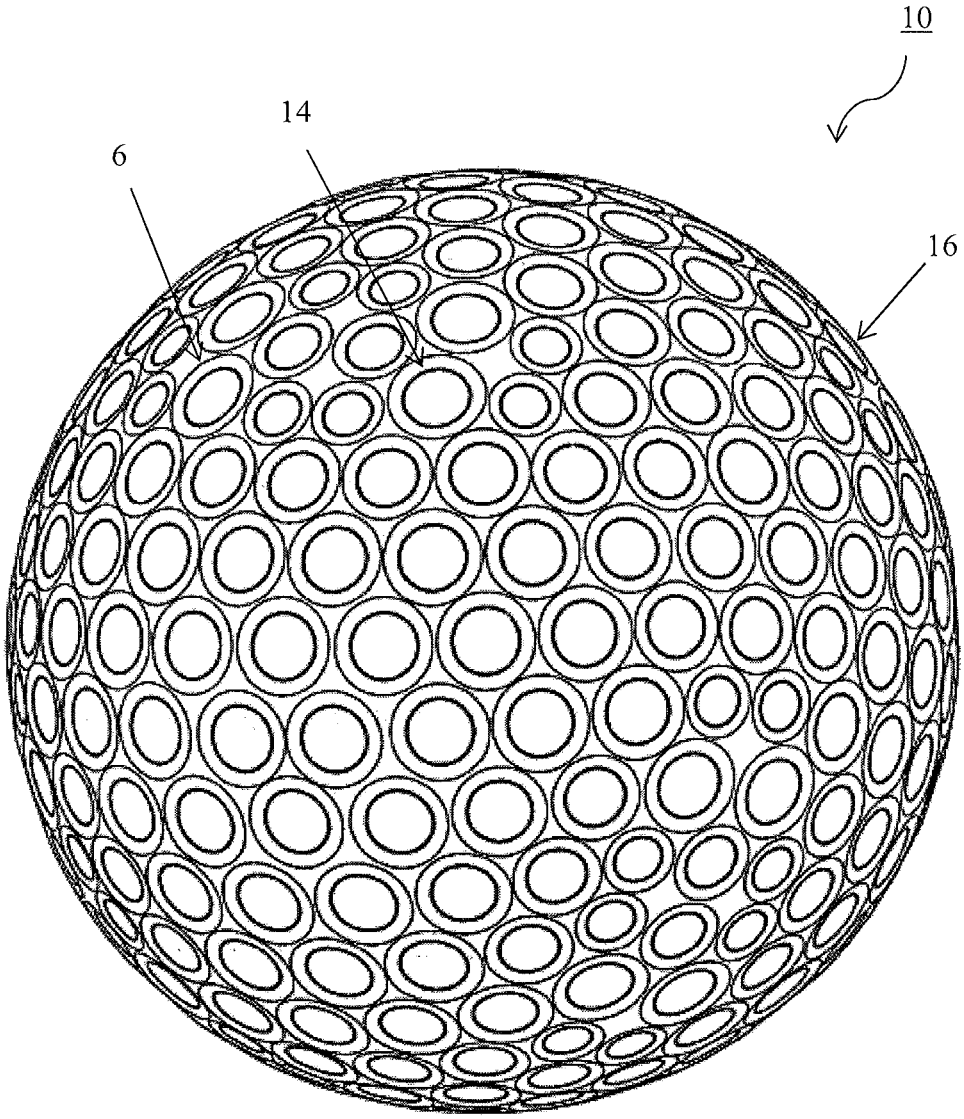
FIG. 7 illustrates a dimple pattern of a golf ball created in accordance with another embodiment of the present invention.
Figure 8:
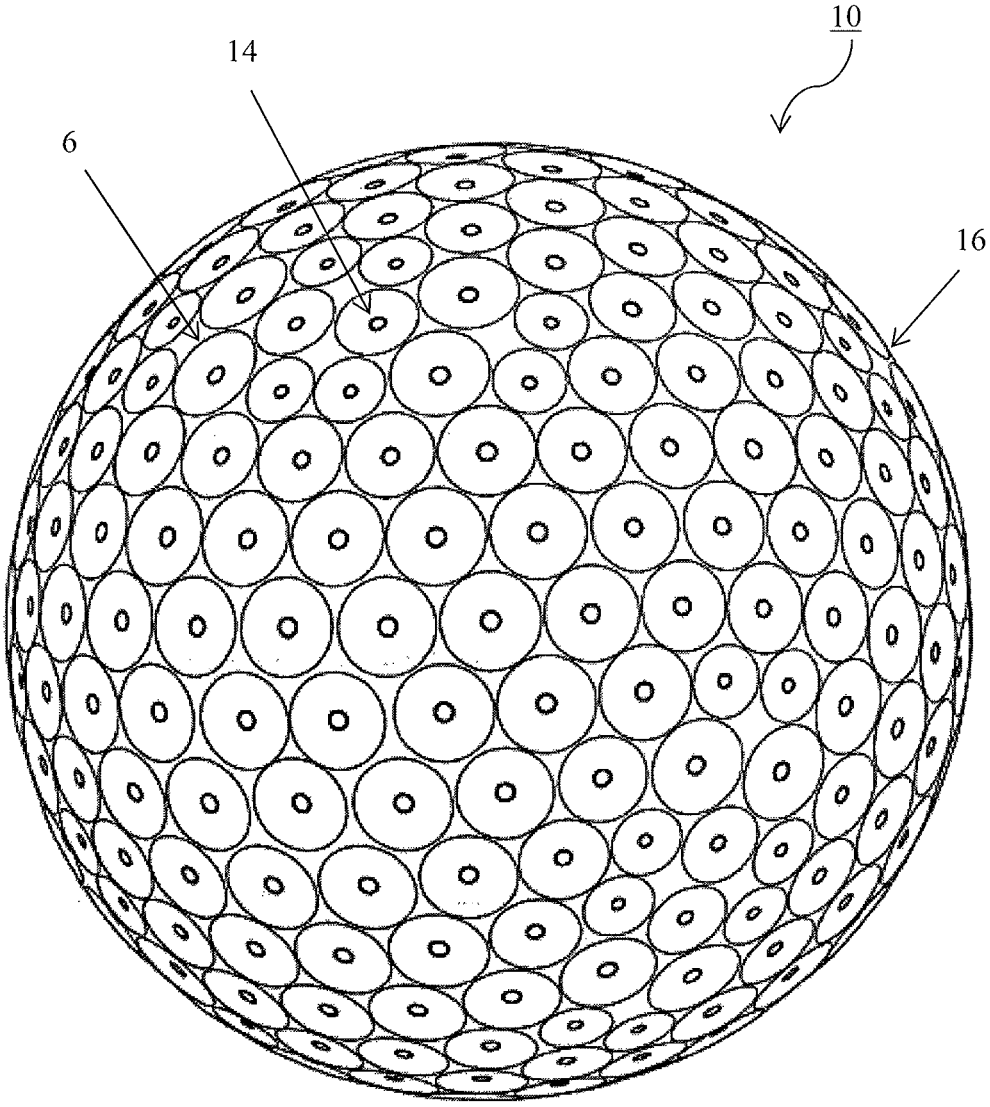
FIG. 8 illustrates a dimple pattern of a golf ball created in accordance with still another embodiment of the present invention.

The grooved dimples produced in accordance with the present invention can be used in constructing a visually distinct dimple pattern that improves the aerodynamic performance of the golf ball. FIGS. 6-8 demonstrate various dimple patterns created in accordance with the present invention. For example, FIG. 5 shows a dimple pattern 16 having grooved dimples produced in accordance with the present invention. As shown in FIG. 6, all of the dimples 6 on the golf ball 10 include a concentric groove 14 having a ratio of the groove diameter D2 to the dimple diameter D1 of 0.90. In this aspect, due to the higher ratio of D2:D1, the concentric groove is located closer to the outer edge of the dimple. FIG. 7 shows a dimple pattern 16 having grooved dimples produced in accordance with another embodiment of the present invention. As shown in FIG. 7, all of the dimples 6 on the golf ball 10 include a concentric groove 14 having a ratio of the groove diameter D2 to the dimple diameter D1 of 0.70.

In still another embodiment, FIG. 8 shows a dimple pattern 16 having grooved dimples produced in accordance with the present invention. As shown in FIG. 8, all of the dimples 6 on the golf ball 10 include a concentric groove 14 having a ratio of the groove diameter D2 to the dimple diameter D1 of 0.20. In this aspect, due to the lower ratio of D2:D1, the concentric groove is located closer to the center of the dimple.

While the present invention is not limited by any particular dimple pattern, dimples having at least one concentric groove according to the present invention are arranged preferably along parting lines or equatorial lines, in proximity to the poles, or along the outlines of a geodesic or polyhedron pattern. Conventional dimples, or those dimples that do not include the concentric groove, may occupy the remaining spaces. The reverse arrangement is also suitable. Suitable dimple patterns include, but are not limited to, polyhedron-based patterns (e.g., tetrahedron, icosahedron, octahedron, dodecahedron, icosidodecahedron, cuboctahedron, and triangular dipyramid), phyllotaxis-based patterns, spherical tiling patterns, and random arrangements.

The dimple patterns of the present invention may be of any count. In one embodiment, the dimple count ranges from about 300 to about 500. In another embodiment, the dimple count is about 302. In still another embodiment, the dimple count is about 328. In yet another embodiment, the dimple count is about 352. In still another embodiment, the dimple count is about 376. In addition, the dimple pattern may include any number of dimple sizes. In one embodiment, the number of dimple sizes range from about 1 to about 30. In another embodiment, the number of dimple sizes range from about 5 to about 20.

In this aspect, the dimple pattern may include about 302 dimples in five sizes. In another embodiment, the dimple pattern may include about 312 dimples in five sizes. In still another embodiment, the dimple pattern may include about 328 dimples in seven sizes. In yet another embodiment, the dimple pattern may include about 352 dimples in five sizes. In still another embodiment, the dimple pattern may include about 376 dimples in eight sizes.

Golf Ball Construction

The grooves of the present invention may be added to the dimples at any point during the construction of the golf ball. In one embodiment, the groove may be added at the tooling stage by milling or burning the groove into the dimples of a dimple pattern. In this aspect, the resulting dimple pattern forms the interior surface of the cavity of a golf ball mold, which can then be used in an injection molding or compression molding process to form a cover layer comprising the golf ball dimple pattern. In another embodiment, the groove may be added after the molding process. In this aspect, the grooves may be added to the dimples by creating indentations in a molded or finished golf ball.

The dimples of the present invention may be used with practically any type of ball construction. For instance, the golf ball may have a two-piece design, a double cover, or two-component dual core construction depending on the type of performance desired of the ball. Other suitable golf ball constructions include solid, wound, liquid-filled, and/or dual cores, and multiple intermediate layers.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

The golf balls of the invention may be formed using a variety of application techniques. For example, the golf ball layers may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials.

EXAMPLES

The following non-limiting examples demonstrate golf ball dimples made in accordance with the present invention. The examples are merely illustrative of the preferred embodiments of the present invention, and are not to be construed as limiting the invention, the scope of which is defined by the appended claims.

The following example illustrates various grooved dimples contemplated by the present invention. In particular, Table 1 provides spherical grooved dimples with varying edge angles and surface coverage (S) where the ratio of $$\frac{S \cdot N}{4\pi R^2 P}$$

is 0.01. N represents the number of grooved dimples on the golf ball, S is equal to the average surface area for all grooves on the ball, P is the surface coverage of the dimple pattern used on the ball, and R is the radius of the ball.

TABLE 1

Spherical Dimples Having Ratio of 0.010

| Edge Angle (°) | Surface Coverage (P) | $4\pi R^2 P$ | Ball Radius (R) | Total Groove Surface Area (S × N) |
|---|---|---|---|---|
| 13 | 0.847 | 7.5102 | 0.84 | 0.075102 |
| 13 | 0.827 | 7.3329 | 0.84 | 0.073329 |
| 13 | 0.804 | 7.1289 | 0.84 | 0.071289 |
| 14 | 0.847 | 7.5102 | 0.84 | 0.075102 |
| 14 | 0.827 | 7.3329 | 0.84 | 0.073329 |
| 14 | 0.804 | 7.1289 | 0.84 | 0.071289 |
| 15 | 0.847 | 7.5102 | 0.84 | 0.075102 |
| 15 | 0.827 | 7.3329 | 0.84 | 0.073329 |
| 15 | 0.804 | 7.1289 | 0.84 | 0.071289 |

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. A golf ball having a substantially spherical surface and comprising a plurality of dimples arranged in a dimple pattern on the spherical surface, wherein the plurality of dimples comprises circular dimples, wherein at least a portion of the plurality of dimples comprise a concentric groove on each dimple surface, wherein each concentric groove has a groove diameter and each dimple has a dimple diameter, wherein a ratio of groove diameter to dimple diameter is about 0.05 to about 0.95, and wherein a ratio of $$\frac{S \cdot N}{4\pi R^2 P}$$

is about 0.01 or less, wherein S is the average surface area for all grooves on the ball, N is the number of grooved dimples on the ball, R is the radius of the ball, and P is the surface coverage of the dimple pattern.

2. The golf ball of claim 1, wherein the groove diameter is about 0.0025 inches to about 0.285 inches.

3. The golf ball of claim 1, wherein the dimple diameter is about 0.050 inches to about 0.300 inches.

4. The golf ball of claim 1, wherein each concentric groove has a width of about 0.00250 inches to about 0.0150 inches.

5. The golf ball of claim 1, wherein each concentric groove has a depth of about 0.0010 inches to about 0.0050 inches.

6. The golf ball of claim 1, wherein the concentric groove has a half circular, triangular, or half square profile.

7. A golf ball having a substantially spherical surface, comprising:

a plurality of dimples on the spherical surface, wherein at least 50 percent of the plurality of dimples comprise a circular perimeter, a dimple profile defined by a continuous function, and at least one concentric groove on a surface of the dimple profile, wherein the golf ball has a ratio of surface area of the grooves on the golf ball to total surface area of the golf ball that is replaced by the plurality of dimples of about 0.010 or less.

8. The golf ball of claim 7, wherein the dimple profile is selected from the group consisting of spherical, conical, catenary, elliptical, polynomial, Witch of Agnesi, frequency, Neiles parabola, sine, cosine, hyperbolic sine, and hyperbolic cosine.

9. The golf ball of claim 8, wherein the dimple profile is spherical, conical, or catenary.

10. The golf ball of claim 8, wherein the concentric groove has a profile that is substantially identical to the dimple profile.

11. The golf ball of claim 7, wherein the concentric groove has a profile defined by the superposition of two or more continuous functions.

12. The golf ball of claim 7, wherein the concentric groove has a half circular, triangular, or half square profile.

13. The golf ball of claim 7, wherein the portion of the plurality of circular dimples has a ratio of groove diameter to dimple diameter of about 0.20 to about 0.80.

14. The golf ball of claim 7, wherein the golf ball has a ratio of surface area of the grooves on the golf ball to the total surface area of the golf ball that is replaced by the plurality of dimples of about 0.008 or less.

15. A golf ball having a substantially spherical surface, comprising:

a plurality of dimples on the spherical surface, wherein at least a portion of the plurality of dimples comprise a circular plan shape; a spherical, conical, or catenary dimple profile; and at least one concentric groove on a surface of the dimple profile, wherein the concentric groove has a diameter of about 0.0025 inches to about 0.285 inches, a depth of about 0.0015 inches to about 0.0050 inches, and a width of about 0.0025 inches to about 0.0150 inches, and wherein the golf ball has a ratio of surface area of the grooves on the golf ball to total surface area of the golf ball that is replaced by the plurality of dimples of about 0.01 or less.

16. The golf ball of claim 15, wherein the concentric groove has a profile selected from the group consisting of half circular, half triangular, half square, half pentagonal, half hexagonal, half heptagonal, or half octagonal.

17. The golf ball of claim 16, wherein the profile of the concentric groove is half circular, triangular, or half square.

18. The golf ball of claim 15, wherein the portion of the plurality of dimples comprise two concentric grooves on the surface of the dimple profile.

19. The golf ball of claim 15, wherein the portion of the plurality of dimples comprise a ratio of groove diameter to dimple diameter of about 0.30 to about 0.70.

* * * * *